US005489063A

United States Patent [19]

Buchalski et al.

[11] Patent Number: 5,489,063

[45] Date of Patent: Feb. 6, 1996

[54] FOOD CONTAINER

[75] Inventors: Brian Buchalski, Hightstown; Wai F. Cheng, East Hanover; Michael Lai, Jersey City; Nelson Yeung, Livingston, all of N.J.

[73] Assignee: W-Y Plastics Products Corp., Jersey City, N.J.

[21] Appl. No.: 732,470

[22] Filed: Jul. 18, 1991

[51] Int. Cl.[6] ..... B65D 5/10

[52] U.S. Cl. ..... 229/117.22; 206/520; 220/318

[58] Field of Search ..... 229/113, 114, 229/117.19, 117.22; 220/94 R, 91, 85 D, 315, 318, 322; 266/518, 519, 520; 292/258, 288

[56] References Cited

U.S. PATENT DOCUMENTS

| | | | |
|---|---|---|---|
| 1,088,964 | 3/1914 | Buchman | 229/186 |
| 2,808,976 | 10/1957 | Chaplin | 220/339 X |
| 3,156,371 | 11/1964 | Harrison | 220/339 X |
| 3,270,939 | 9/1966 | Ebelhardt | 229/117.19 |
| 3,282,462 | 11/1966 | Box | 220/339 X |
| 3,389,828 | 6/1968 | Godshalk | 206/519 |
| 3,425,471 | 2/1969 | Yates, Jr. | 206/519 |
| 3,445,052 | 5/1969 | Lewallen | 220/339 X |
| 3,746,205 | 7/1973 | Helguera | 220/323 |
| 3,892,331 | 7/1975 | Beck | 220/96 |
| 3,960,289 | 6/1976 | Panicci | 220/96 |
| 4,181,226 | 1/1980 | Weinert | 206/519 |
| 4,231,476 | 11/1980 | Compton et al. | 206/520 |
| 4,476,994 | 10/1984 | Hope et al. | 220/318 |
| 4,478,348 | 10/1984 | Cook | 220/318 |
| 4,534,466 | 8/1985 | Wood | 206/520 |
| 4,826,013 | 5/1989 | Heikkinen | 206/520 |
| 4,976,371 | 12/1990 | Wise et al. | 220/315 |
| 5,044,513 | 9/1991 | Van Berne | 220/94 R |

*Primary Examiner*—Allan N. Shoap
*Assistant Examiner*—Christopher McDonald
*Attorney, Agent, or Firm*—William Squire

[57] ABSTRACT

A plastic container has four trapezoidal walls that slant upward and outward to create a top that is larger than its bottom. Each sidewall has a closure flap that is connected to it by a living hinge. There are projections on two opposed sidewalls that are attachment points for a handle. The handles have several apertures that mate with the projections. The plurality of apertures allow the handle to be attached in close relation to the top of the container, allowing the handle to act as a tie-down for the closure flaps. The container also employs several means to limit the extent of nesting of the containers.

14 Claims, 1 Drawing Sheet

FOOD CONTAINER

BACKGROUND OF THE INVENTION

The present invention relates to a food container, and, more particularly, to a molded plastic food container generally having the configuration and features of the type of container typically used to transport oriental food for the off-premises consumption thereof.

Food containers made from folded cardboard—such as SBS or bleached board—or similar paper-like materials are known. Once the cardboard has been appropriately folded, the resulting containers typically include a flat bottom surrounded by four sloped upstanding sidewalls, the upper edges of which define an opening which is above and opposite from the bottom. The opening is closeable by four flaps each of which is connected to the upper edge of one of the sidewalls. The flaps may be outwardly folded to expose the opening to permit placement of food into the container. Thereafter, the flaps may be inwardly folded to cover and close the opening. One of the flaps may include a slit near its free edge and the diametrically opposed flap may include a tab or tongue on its free edge. The tab may be interfitted into the slit to hold the flaps closed. The ends of a piece of formed wire are inserted through and attached to portions of the folded cardboard to constitute a handle for the container and to maintain the container in its folded condition.

The slope of the sidewalls of folded cardboard food containers has traditionally been approximately 6° away from the vertical major axis of the container. It was apparently empirically found many years ago that such a 6° slope offered several advantages. Specifically, the 6° slope permits empty folded containers with their flaps unfolded and not covering their openings to be conveniently nested and stacked and thereafter separated for use and storage. Nesting and stacking is achieved by inserting an upper container into a lower container. An angle much smaller than 6° (i.e., about 4°) results in the containers becoming self-locking or jammed together and difficult to separate. A significantly larger angle may render a nested stack of the containers unstable and permit the stock to fall over.

Folded cardboard containers have several disadvantages. First, much of the cardboard which goes into the folded container is "wasted" in that it serves no function other than to permit the container to be folded into a leak-proof unit. Those portions of the folded cardboard to which the ends of the wire handle are usually connected constitute, for the most part, excess cardboard, the elimination of which would constitute a savings.

Second, although the typical cardboard (e.g., SBS or bleached board) used to manufacture folded food containers often includes a moisture-resistant coating, the presence of food in a container for a substantial period time can nonetheless degrade the cardboard; it is not certain that cardboard containers are suitable for long term storage of food therein. Third, the presence of a wire handle on the container renders these containers unsuitable for reheating the contents thereof in older microwave ovens, the presence of metal in which can cause certain operating difficulties. Fourth, removal of the metal handle—to facilitate microwave heating or for other reasons—permits the cardboard container to unfold and can destroy its leak-proof integrity. Fifth, although the traditional cardboard container, as noted, has its sidewalls sloped at 6° from the vertical to facilitate nested stacking and removal of containers from the stack, the surface of the cardboard and the ease of forcing together adjacent containers in the stack sometimes renders inconvenient the removal of a single container from the stack for the placement of food therein.

An object of the present invention is the provision of a molded plastic container which meets the criteria of the traditional folded cardboard container, particularly those used for the sale of oriental foods, but which avoids the disadvantages of such prior art containers.

SUMMARY OF THE INVENTION

With the above and other objects in view, the present invention contemplates a container for food. The container comprises a molded plastic container having a generally rectangular bottom and four integral, contiguous upstanding sidewalls defining a top opening. The sidewalls may be sloped away from the container's vertical axis by the "traditional" angle of 6°.

A flap is associated with the upper edge of each sidewall. Living hinge facilities join an edge of each flap to the upper edge of its associated sidewall and permit the flaps to be inwardly folded to overlie and close the opening and to be unfolded to uncover the opening. Facilities integral with the free edge of one flap and with the free edge of another flap, which is diametrically opposite the one flap, maintain the flaps in place after they have been inwardly folded. These facilities may constitute a tab or tongue on a free edge of one of the flaps and a slit near a free edge of the other flap. Facilities integral with the exterior of two opposed sidewalls and adjacent to the living hinge facilities thereof may selectively mount and demount a plastic strap to the container. Preferably the mounting/demounting facilities are on the sidewalls which mount the flap which contain the facilities for mantaining the flaps folded.

In preferred embodiments, the container is nestable and stackable with like containers by inserting the bottom of one container into the opening of another container so that the similar sidewalls and flaps of the containers are adjacent and generally parallel. The handle mounting and demounting facilities of the inserted container limit the amount of this insertion to facilitate later removal of the inserted container from the other container. In specific embodiments where the mounting and demounting facilities comprise a headed projection, the headed projection limits the amount of insertion by engaging the edges of the sidewalls of the other container and the associated living hinge facilities.

In further preferred embodiments, a strap, which may be mounted to the container by the mounting and demounting facilities, includes a first facility such as a hole or slit or the like at or near one end for mounting the one end to the mounting and demounting facility. A plurality of similar facilities, such as a number of holes or slits, extend along the strap from the other end thereof for mounting a selected site of the strap to the other mounting or demounting facility. This permits the strap to selectively serve as either a carrying handle overlying and spaced from the inwardly folded flaps, or as a hold-down facility which overlies and engages the inwardly folded flaps. With the strap mounted to the container it may be rotated to overlie the folded flaps or away therefrom so that the flaps may be opened.

Facilities may also be provided on the interior of the container, for limiting insertion of the one inserted container. This insertion-limitation is achieved by abutment of the limitation facility, which may be a projection or shelf, with the exterior of the bottom of the inserted container. The conjoint insertion-limiting action of the limiting facilities and the handle mounting and demounting facilities ensures that stacked containers may be easily removed one from the other.

DETAILED DESCRIPTION

Figure 1:
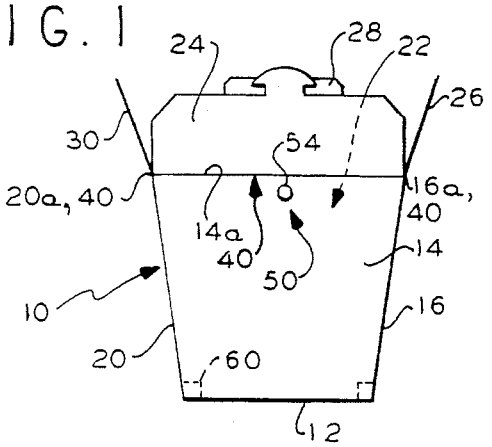
FIG. 1 is a front elevation of a container according to the present invention with closable flaps thereof in an open position.
Figure 2:
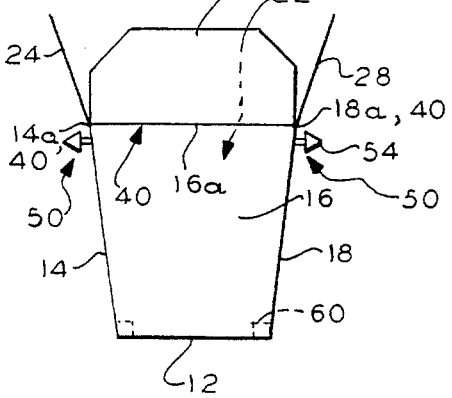
FIG. 2 is a side elevation of the container in FIG. 1.
Figure 3:
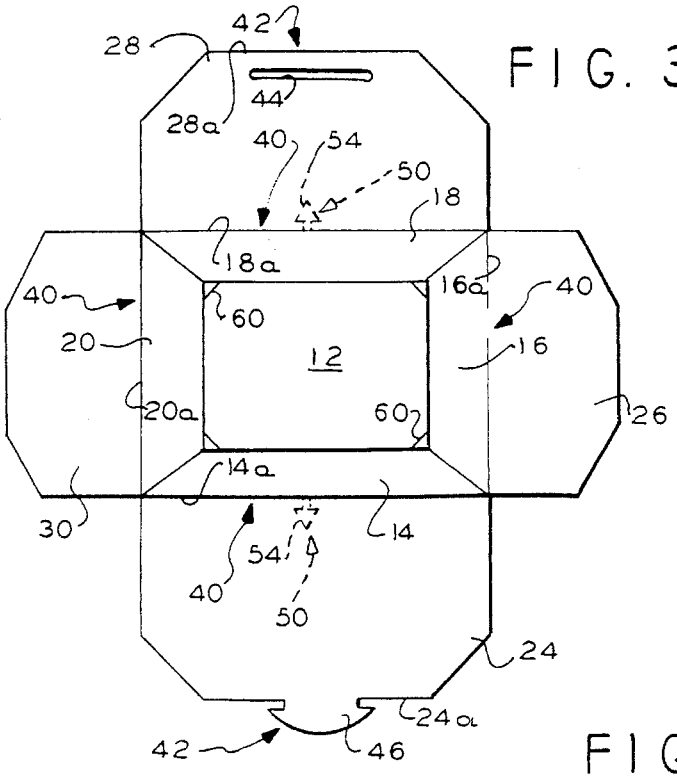
FIG. 3 is a top view of the container shown in FIGS. 1 and 2 with the flaps thereof fully opened.

Referring first to FIG. 1 there in shown a front elevation a molded plastic container 10 according to the present invention. The molded plastic container 10 may be made of a variety of moldable or formable plastic materials, including, without limitation, polypropylene, polyethylene, PET or copolymers of the foregoing, and may be formed by a variety of technique such as injection molding and thermo (or vacuum) forming.

As may be seen from the Figures, the molded plastic container 10 of the present invention has the general configuration and appearance of the typical prior art folded cardboard container used for the storage, sale and off-premises consumption of oriental foods. The container 10 has a generally rectangular bottom 12 and four integral, contiguous upstanding sidewalls 14, 16, 18 and 20. The sidewalls define a top opening 22 into the interior of the container 10. Associated with the upper edges 14*a*, 16*a*, 18*a* and 20*a* of each sidewall 14, 16, 18, and 20 are flaps 24, 26, 28 and 30.

The flaps 24, 26, 28 and 30 are joined to the edges 14*a*, 16*a*, 18*a* and 20*a* of their associated sidewalls 14, 16, 18 and 20 by hinges 40, which are, preferably, so-called "living hinges". As is well known, the living hinges 40 constitute decreased thickness portions of molded plastic which permit the flaps 24, 26, 28 and 30 to be pivoted or rotated relative to the side wall 14, 16, 18 and 20 to which they are connected by the living hinges 40. In the case of the container 10, the living hinges 40 permit each flap 14, 16, 18, and 20 to be inwardly folded to overlie and close the opening 22 and to be fully unfolded to uncover the opening 22. The living hinges 40 are formed during the molding of the container 10.

Facilities 42 are provided for maintaining the flaps 24, 26, 28 and 30 in place after they have been inwardly folded. Typically, the flaps 26 and 30 are folded inwardly first and then the flaps 24 and 28 are folded inwardly to overlie the flaps 26 and 30. In preferred embodiments the facilities 42 constitute a slit 44 formed through one flap 28 near its free edge 28*a* and a tab 46 or tongue formed on the free edge 24*a* of the diametrically opposed flap 24. As noted, the two flaps 26 and 30 are first folded inwardly to partially close the opening 20 and then following inward folding of the flaps 24 and 28, the tab 46 is inserted into the slit 44 to retain all of the flaps folded over the opening 22. Equivalent facilities, such as a differently shaped tab and/or slit or interlocking tabs, are contemplated hereby.

Figure 5:
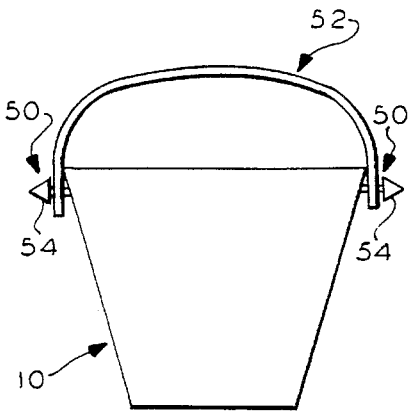
FIGS. 5 and 6 illustrate the strap of FIG. 4 as a handle (FIG. 5) or as a hold-down (FIG. 6).
Figure 4:
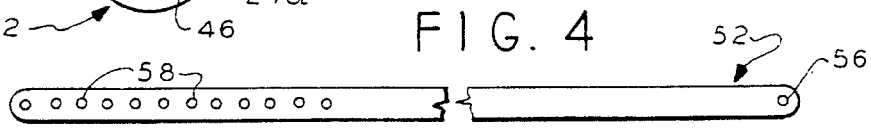
FIG. 4 depicts a strap which may be used with the container of FIGS. 1–3.

On opposed sidewalls, preferably the walls 14 and 18 with which the flaps 24 and 28 are associated, there are facilities 50 for mounting a strap 52 (FIGS. 4–6) to the container 10. As may be seen, the facilities 50 may comprise a headed stud or projection 54 with extends away from the sidewalls 14 and 18 near the upper edges 14*a* and 18*a* thereof. The strap 52 comprises a molded plastic member having a single hole 56 at one end thereof and a plurality or series of holes 58 formed at and extending away from the other end of the strap 52. In use, the hole 56 is forced over one headed stud 54 until the hole 56 bypasses the head and is retained on the stud 54. Thereafter, as shown in FIG. 5, a hole 58 at or near the other end of the strap 52 may be similarly placed over the stud 54 on the opposite side wall so that the strap 52 assumes the configuration of a carrying handle.

Figure 6:
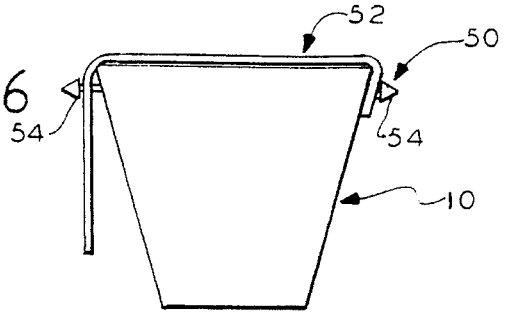

As shown in FIG. 6, the strap 52 may also serve the function of a hold-down. Specifically, after placing the hole 56 over one stud 54, a hole 58 remote from the other end of the strap may be placed over the other stud 54 so that the strap 52 conforms to and holds down the inwardly folded flaps 24, 26, 28 and 30 of the container 10.

The strap 54 may be affixed to the studs 54 by the manufacturer or supplier or, as is preferable, by the end user, in which latter event containers 10 and straps 54 are supplied separately and disassociated. The studs 54 may have other configurations or may be replaced by functionally equivalent members, such as hooks or the like. Further, if wire handles are deemed to be not disadvantageous, the studs 54 may be replaced by extensions with holes therethrough for attachment thereto of such wire handles.

Molded into the container 10 on the interior of on or more of the sidewalls 14, 16, 18 and 20 or on the bottom 12 may be one or more ledges or stops 60. When the containers 10 are stored prior to use it is preferred that they be nested and stacked. To this end, the sidewalls 14, 16, 18 and 20 of the container 10 may be formed at the "traditional" angle of approximately 6° relative to the vertical. The handle-mounting studs 54 (or their funcational equivalents) and the ledges 60 serve the function of ensuring that the containers 10 may be conveniently removed from a nested stack thereof.

Specifically, when a first container 10 is placed within a second container 10, following a certain amount of insertion, the studs 54 on the opposed walls 14 and 18 contact the edges 14*a* and 18*a* of the container 10 into which the first container 10 is inserted. This engagement limits the amount of inward insertion of the first container 10 into the second container 10 to that which permits the inserted container to be later easily removed without jamming or self-locking. Similarly, the bottom of the first inserted container preferably engages the ledges 60 at approximately the same time that the studs 54 of the inserted container 10 engage the edges 14*a* and 18*a* of the second container. It should be clear that the studs 54 alone or the ledges 60 alone may serve the function of limiting insertion of the nested containers 10 into each other in a stack of containers 10 to permit convenient removal thereof. It is preferred, however, that both be present.

Those skilled in the art will appreciate that changes in the above container 10 may be made without departing from the spirit and scope of the following claims.

We claim:

1. A container for food, comprising:

a molded or formed plastic container having a generally rectangular bottom and four integral, contiguous upstanding side walls defining a top opening, a flap associated with the upper edge of each side wall;

living hinge means for joining one edge of each flap to the upper edge of its associated side wall and for permitting the flaps to be inwardly folded to overlie and close the opening and fully unfolded to uncover the opening;

means integral with the free edge of one flap and with the free edge of the flap which is diametrically opposite the one flap for maintaining such flaps in place after they have been inwardly folded; and means integral with the exterior of two opposed side walls and adjacent to the living hinge means associated with such side walls for permitting selective mounting and demounting of a plastic strap to the container.

2. A container as in claim 1, wherein:

the container is nestably stackable with a like container by inserting the bottom of one container into the opening of the other container so that the similar side walls and flaps of the containers are adjacent and generally parallel, and the mounting and demounting means of the one inserted container limit the amount of insertion.

3. A container as in claim 2, wherein:

the mounting and demounting means limit insertion by engagement with the free edges of the side walls of the other container and the associated living hinge means.

4. A container as in claim 3, wherein:

the mounting and demounting means comprises a member integral with the exterior of each opposed side wall and extending away therefrom.

5. A container as in claim 4, wherein the member is a headed stud.

6. A container system which includes the container as set forth in claim 3, and which further comprises:

a strap having first mountable means at or near one end for mounting on one of the mounting and demounting means, and a plurality of second mountable means extending along the strap from the other end thereof for mounting a selected site of the strap on the other mounting and demounting means to selectively permit the strap to serve as either a carrying handle overlying and spaced from the inwardly folded flaps or a hold-down overlying and engaging the inwardly folded flaps.

7. A container system as in claim 6 wherein:

with the strap mounted to serve as a handle, the strap is rotatable about the mounting and demounting means on the first and second mountable means between a first position whereat the strap overlies the inwardly folded flaps and second position whereat the strap is remote from the inwardly folded flaps, the flaps being capable of being freely unfolded when the strap is in its second rotatable position or when one of the mountable means does not mount the strap to one of the mounting and demounting means.

8. A container as in claim 2, which further comprises:

means formed on the interior of the container for limiting insertion of the one inserted container by abutment with the exterior of the bottom of the one container.

9. A container as in claim 8, wherein:

the mounting and demounting means on the one inserted container limit insertion by engagement with the free edges of the side walls and the associated living hinge means of the other container.

10. A container as in claim 9, wherein:

engagement between the mounting and demounting means and free edges occurs substantially simultaneously with abutment between the limiting means and the exterior of the bottom.

11. A container as in claim 1, wherein:

the maintaining means comprises a tab integral with the other free edge of the one flap, and a slot formed near the other free edge of, and through, the diametrically opposite flap, the tab being insertable into the slot when the one flap and the diametrically opposite flap are inwardly folded.

12. A container system which includes the container as set forth in claim 1, and which further comprises:

a strap having first mountable means at or near one end for mounting on one of the mounting and demounting means, and a plurality of second mountable means extending along the strap from the other end thereof for mounting a selected site of the strap on the other mounting and demounting means to selectively permit the strap to serve as either a carrying handle overlying and spaced from the inwardly folded flaps or a hold-down overlying and engaging the inwardly folded flaps.

13. A container for food, comprising:

a molded plastic container having a generally rectangular bottom and four integral, contiguous, upstanding side walls which are exteriorly and interiorly planar and which define a top opening;

a flap associated with the upper edge of each side wall;

living hinge means for Joining one edge of each flap to the upper edge of its associated side wall and for permitting the flaps to be inwardly folded to overlie and close the opening and fully unfolded to uncover the opening;

first means integral with the free edge of one flap and with the free edge of the flap which is diametrically opposite the one flap for maintaining such flaps in place after they have been inwardly folded;

second means integral with the exterior of two opposed side walls and adjacent to the living hinge means associated with such side walls for permitting selective mounting and demounting of a plastic strap to the container, the container being nestably stackable with a similar container by inserting the bottom of the similar container into the opening of the container so that the congruent side walls and flaps of the containers are adjacent and generally parallel; and third means formed on the interior of the container for limiting insertion of the inserted container by abutment with the exterior of the bottom thereof, the second means also limiting such insertion by engagement with the free edges of the side walls and the associated living hinge means of the container, engagement between the second means and both the free edges and the living hinges occurring substantially simultaneously with abutment between the limiting means and the exterior of the bottom of the inserted container.

14. A container system which includes the container set forth in claim 13, and which further comprises:

a strap having first mountable means at or near one end for mounting on one of the mounting and demounting means, and a plurality of second mountable means extending along the strap from the other end thereof for mounting a selected site of the strap on the other mounting; and demounting means to selectively permit the strap to serve either as a carrying handle overlying and spaced from the inwardly folded flaps or as a hold-down overlying and engaging the inwardly folded flaps.

* * * * *